United States Patent [19]

Grant et al.

[11] 4,424,957

[45] Jan. 10, 1984

[54] HOT METAL CAR HEAT RETENTION SHIELD

[75] Inventors: Louis A. Grant, Pittsburgh; Arthur F. Trunzo, White Oak, both of Pa.

[73] Assignee: Standard Steel Sponge, Inc., Pittsburgh, Pa.

[21] Appl. No.: 342,517

[22] Filed: Jan. 25, 1982

[51] Int. Cl.[3] ..... F27D 3/00

[52] U.S. Cl. ..... 266/248; 266/275; 266/280; 266/287; 428/920

[58] Field of Search ..... 266/165, 287, 280, 248, 266/275, 199; 228/59; D9/435; D12/197; 252/62; 428/920

[56] References Cited

U.S. PATENT DOCUMENTS

| | | | |
|---|---|---|---|
| D. 141,764 | 7/1945 | Johnson | D12/197 X |
| 2,767,878 | 10/1956 | Brown | D9/435 X |
| 3,438,529 | 4/1969 | Lohrer | D9/435 X |
| 3,907,260 | 9/1975 | Leatherby | 266/287 |
| 3,979,016 | 9/1976 | Frater | D9/435 X |
| 4,014,532 | 3/1977 | Holley | 266/287 |
| 4,269,619 | 5/1981 | Keil et al. | 266/165 X |
| 4,381,855 | 5/1983 | Ryan | 266/248 |

OTHER PUBLICATIONS

Mazy Industrial sales-Ad; Industrial Heating, Feb. 1982, p. 29.

*Primary Examiner*—G. Ozaki
*Assistant Examiner*—David A. Hey
*Attorney, Agent, or Firm*—Parmelee, Miller, Welsh & Kratz

[57] ABSTRACT

A consumable heat retention shield for retaining the heat of the interior lining of a hot metal car includes a combustible framework having a bottom wall, upstanding walls and a flange, with the surface thereof that is to be directly exposed to the hot metal car covered with a layer of refractory material, with the shield being manually positioned on the hot metal car by workmen, and the shield consumable upon pouring of molten metal upon the shield and through the mouth of the hot metal car. Preferably, the shield has a metallic filler material in a cavity thereof to provide additional weight to the shield, which metallic filler material is compatable with the molten metal charged to the hot metal car.

8 Claims, 4 Drawing Figures

HOT METAL CAR HEAT RETENTION SHIELD

BACKGROUND OF THE INVENTION

The present invention relates to a consumable heat retention shield for use in conserving the heat of the refractory lining of a hot metal transfer car.

Hot metal transfer cars, sometimes called torpedo cars, are large vessels used in metallurgical processing to transfer molten metal between stations in a steel mill, for example transferring molten metal from a blast furnace to a BOF processing station. The cars are elongated vessels, rotatably supported on wheels, which have steel plate bodies lined interiorly with refractory brick material. The vessels have a mouth for charging and discharging metal which is generally upright to receive molten metal and relatively horizontally and slightly downwardly directed for pouring of metal therefrom.

When used between a blast furnace and a BOF station, molten metal is charged to the vessel from the blast furnace and the vessel travels to the BOF station for discharge of the metal. After the metal is discharged from the vessel, the empty car is returned to the blast furnace area for re-use.

With the ever rising costs of energy, it is imperative in steel making operations to retain heat of a melt, wherever possible, so as to reduce energy consumption. With torpedo cars, for example, the heat of molten metal is transferred to the refractory lining of the car. Upon discharge of the hot metal, that has been received from a blast furnace, the heat of the refractory lining of the hot metal car is slowly dissipated through the open mouth of the vessel with resultant cooling of the refractory during the wait for recharging of the vessel. When a fresh supply of molten metal is charged to the vessel, heat from the metal is again lost to the refractory.

It has been known to use a form of shield to cover such an opening, such as a screen-enclosed refractory containing sheet which can be suspended from supports, such as hooks, affixed to the metal shell of the hot metal car. Such devices, however, require the use of lifting devices and delicate positioning of the sheet in order to fit the same into position.

The present invention provides a consumable heat retention device for retaining the heat of the refractories of a hot metal car which is easily produced and readily positioned by workmen, without the need for heavy lifting equipment, and is consumable such that the same need not be removed from the hot metal car prior to pouring of metal thereto.

BRIEF DESCRIPTION OF THE INVENTION

A consumable heat retention device for retaining the heat of the interior lining of a hot metal car includes a supporting framework of consumable material, such as cardboard or plywood, the framework having a bottom wall and upstanding side walls that are insertable into the mouth of the hot metal car, with an outwardly extending flange on the upstanding walls such that the flange supports the framework on the hot metal car body. First or outer surfaces of the bottom wall, upstanding sidewalls and the flange have a layer of insulating material thereover to protect the framework, and the workmen, from hot metal car body and the radiant heat from the car lining, with the insulating material preferably covering the outer and inner surfaces thereof. The heat from the refractories eventually softens the framework so as to form a drape-like shield. The whole structure is forced into the car during pouring of hot metal into the car, with the shield consumed.

DETAILED DESCRIPTION

The heat retention shield for heat retention of the refractory lining of a hot metal car of the present invention is formed from a lightweight framework covered with a refractory layer and is easily handled and positioned by mill workmen.

Figure 1:
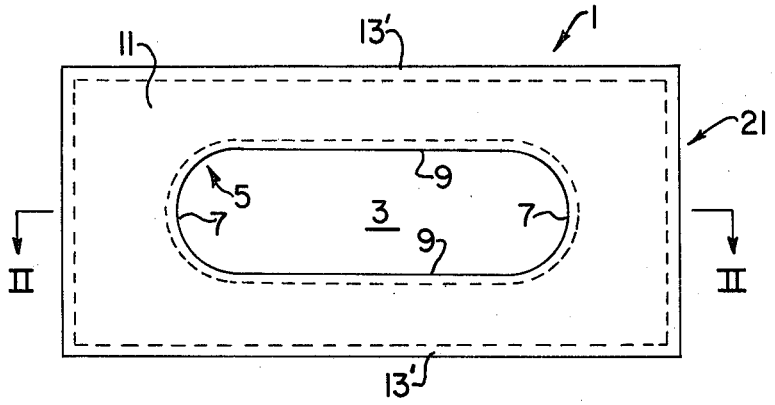
FIG. 1 is a plan view of the top of one embodiment of a consumable heat retention shield of the present invention.

Referring now to the drawings, FIG. 1 illustrates a consumable heat retention shield 1, which comprises a consumable framework having a bottom wall 3 and upstanding walls 5. The upstanding walls 5 may comprise end walls 7 and side walls 9, or may be of a rounded or oval shaped construction, which walls can be solid or lattice-like in construction. The bottom wall 3, upstanding walls 5 and flange 11 are formed of a lightweight but consumable, such as by combustion, material such as cardboard, expanded foam polymeric material, lightweight plywood or the like, the material providing structural stability for the framework while still being relatively lightweight so as to be manually handled. Preferably, the complete framework is constructed of a material that will combust below the temperature of molten iron, although some reinforcement material that will liquefy and become part of the molten metal may be present.

In order to protect the consumable framework from the hot temperature to which the heat retention shield will be subjected, a layer of refractory material 13 is placed over the first surface 15 of the bottom wall 3, the first surface 17 of the upstanding walls 5, the first surface 19 of the flange 11, with the refractory extending around the edge 21 of flange 11, to encase the edge and protect the same. The term first surface, or as used herein, designates the surface of the framework that would be directly exposed to the heat of the refractories of a hot metal car, and the metal shell thereof, either by insertion into the mouth of the car or draping over the metal shell.

Figure 2:
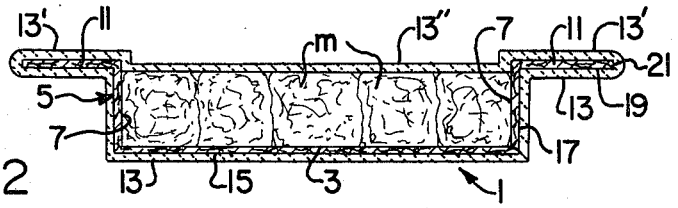
FIG. 2 is a cross-sectional view of the consumable heat retention shield taken along lines II—II of FIG. 1, with metallic filler present.

In the preferred embodiment of the present invention, as illustrated in FIG. 2, a consumable filler material, m, which may be a skeletal metallic sheet material, such as a foraminous steel sheet compatable with molten iron, is formed into bundles and placed into the cavity formed by the bottom wall 3 and upstanding walls 5. The filler material provides weight for the heat retention device to withstand wind and other forces which might tend to loosen the shield after it has been placed on a hot metal car. As illustrated, a plurality of such metallic bundles of material, m, are used and the weight of the heat retention shield may be primarily determined by the number of such bundles. Also, in the preferred embodiment, the layer of refractory material is extended over the filler material, m, as at 13" to completely encase the framework and filler material. The preferred refractory material is a lightweight fibrous ceramic material which is available in sheet form and readily attached to the framework. Such material may be used in thicknesses as low as about ¼" and provide the required protection for the framework. One such material is sold by Carborundum Company under the trademark Fiberfrax. The refractory material must be such that it will protect the framework at temperatures about that of molten iron, i.e. 2200°-2400° F., and protect the consumable framework from ignition due to those high temperatures. The filler material, m, is inserted into the cavity and may be affixed to the bottom wall, such as by stapling, or the same may be force fit into the cavity and held in place by a friction fit.

Figure 3:
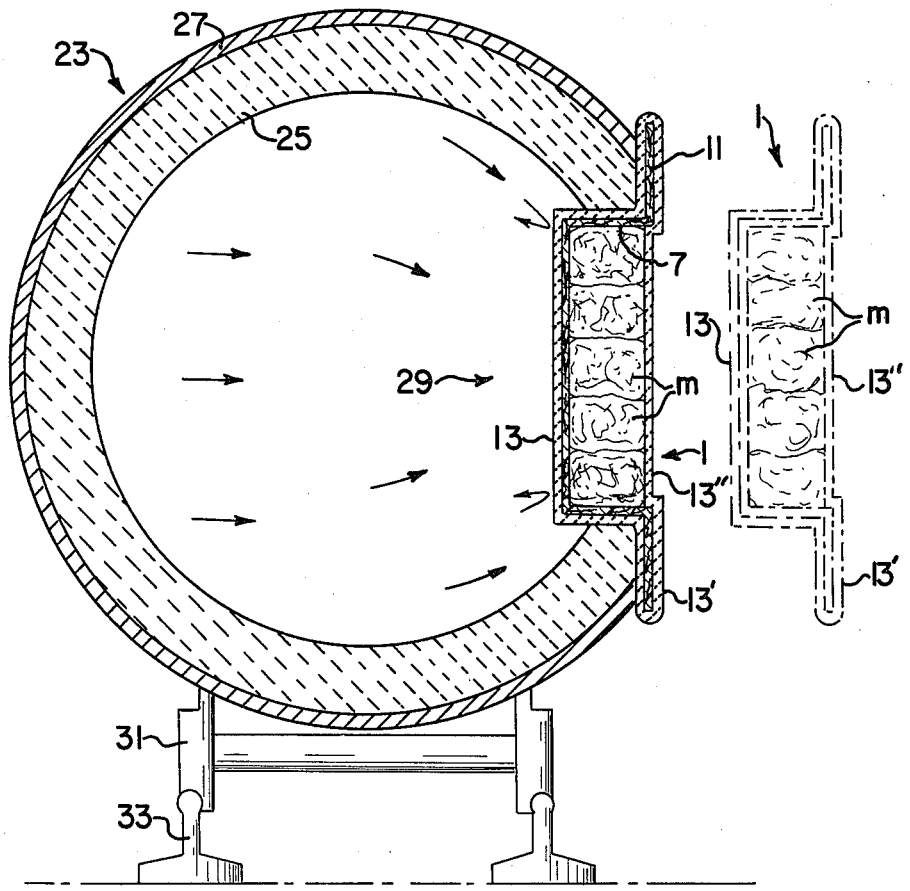
FIG. 3 is a sectional view of a hot metal car showing the consumable heat retention shield of the present invention in place to retain heat therein.
Figure 4:
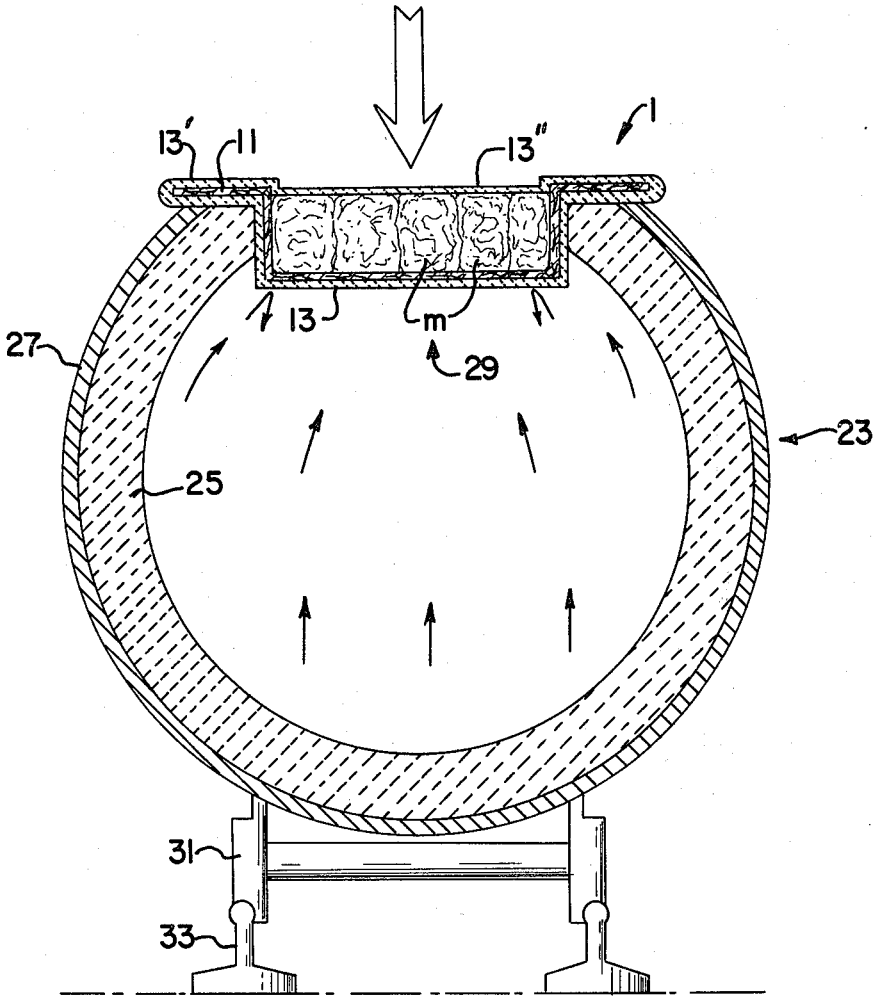
FIG. 4 is a sectional view similar to FIG. 3 showing the consumable heat retention shield in place with the car positioned for receipt of hot metal.

In describing the use of the shield of the present invention, attention is drawn to FIGS. 3 and 4 which illustrate the initial positioning of the consumable heat retention shield and the position thereof when the hot metal car is positioned for receipt of a fresh supply of molten metal.

A hot metal car 23 from which molten metal has been discharged is illustrated in FIG. 3, the car comprising a refractory lining 25 that is supported by a metal shell 27, with a mouth 29, the shell being rotatably mounted on wheels 31 by means (not shown) such that the car can travel along trackway 33. The hot metal car and transfer means therefore, are known in the art. The refractory lining 25 of the hot metal car, after dumping of its charge, will be hot and heat therefrom, which should preferably be conserved, will normally be lost through the mouth 29 of car.

The heat retention shield of the present invention is positioned by workers who, while holding the heat retention device 1, by use of handles (not shown), position the same between them and the open mouth 29 of the hot metal car 23, to shield them from the heat therefrom, as indicated in phantom in FIG. 3. The workers then advance towards the mouth 29 of the hot metal car and place the shield 1 into position, as shown, to seal the mouth. The bottom wall 5 and side walls 7 are adapted to be inserted into the relatively horizontally disposed mouth 29 of the car 23, while the flange 11 contacts the metal shell 27. The car is then rotated, as is conventional, so that the mouth 29 is vertically disposed and the flange 11 will drape over the perimeter of the mouth with the bottom wall 3, side walls 5, and flange 11 sealing the mouth of the vessel, as shown in FIG. 4. Such draping provides a blanket-like effect to seal the mouth of the hot metal car.

The hot metal car with the heat retention device in place is then returned to the blast furnace, or other hot metal station, with the heat of the refractories 25 being retained within the hot metal car by the shield 1.

Upon subsequent recharging of the hot metal car 23 with molten metal, (shown by the block arrow in FIG. 4), such as iron, the molten metal will force the device 1 through the mouth 29 and into the interior of the hot metal car where the consumable framework preferably of combustible material will be combusted while the filler material is liquified to become part of the melt. The only contaminant to the melt will be the small amount of fibrous refractory material which will be insignificant relative to the quantity of molten metal, in that hot metal cars are designed to accept molten metal in quantities on the order of 100 to 250 tons.

What is claimed is:

1. A lightweight and manually positionable consumable heat retention shield for conserving the heat of the interior lining of a hot metal car into which hot metal is to be poured, the car having a body portion, with an aperture therein for pouring molten metal therein and discharging molten metal therefrom, comprising:

(a) a supporting framework of combustible material having a bottom wall portion, upstanding walls about the bottom portion and a flange extending outwardly from the upstanding walls; the bottom wall portion, upstanding walls and flange having a first surface which is adapted for exposure to the hot temperatures of the hot metal car, and a second surface which forms a cavity; and (b) a layer of refractory material covering at least the first surfaces of the bottom wall portion, upstanding walls and flange, the bottom wall portion and upstanding walls arranged for insertion into the aperture of the hot metal car with the flange resting on the body portion thereof, such that the shield is positionable on the car to seal said aperture, without the use of mechanical attachment means, and the shield, upon pouring of hot metal into the car, is forced through the aperture and consumed.

2. The consumable heat retention shield of claim 1 wherein the layer of refractory material encases the framework.

3. The consumable heat retention shield of claim 1 including a filler material positioned with the cavity formed by the bottom wall and the upstanding walls.

4. The consumable heat retention shield of claim 3 wherein the layer of refractory material substantially encases the framework and filler material.

5. The consumable heat retention shield of claim 4 wherein said filler material comprises a plurality of metallic bundles of foraminous sheet metal.

6. The consumable heat retention device of claim 1 wherein said framework is formed from a material combustible below the temperature of molten iron.

7. A lightweight and manually positionable, consumable heat retention shield for conserving the heat of the interior lining of a hot metal car into which hot metal is to be poured, the car having a body portion, with an aperture therein for pouring molten metal therein and discharging molten metal therefrom comprising:

(a) a supporting framework of combustible material having a bottom wall portion, upstanding walls about the bottom portion and a flange extending outwardly from the upstanding walls; the bottom wall portion, upstanding walls and flange having a first surface which is adapted for exposure to the hot temperatures of the hot metal car, and a second surface which forms a cavity;

(b) a filler material comprising a plurality of metallic bundles of a metal compatible with iron positioned within the cavity; and (c) a layer of refractory material covering at least the first surfaces of the bottom wall portion, upstanding walls and flange; the bottom wall and upstanding walls arranged for insertion into the aperture of the hot metal car with the flange resting on the body portion thereof, such that the shield is positionable on the car to seal said aperture, without the use of mechanical attachment means, and the shield, upon pouring of hot metal into the car is forced through the aperture and consumed.

8. The consumable heat retentions shield of claim 7 wherein the layer of refractory material substantially encases the framework and filler material.

* * * * *